US005795022A

United States Patent [19]

Brown

[11] Patent Number: 5,795,022

[45] Date of Patent: Aug. 18, 1998

[54] APPARATUS FOR PROVIDING MOBILITY AND FLOATATION-LIKE EFFECT TO A SEAT OR CHAIR

[75] Inventor: Michael A. Brown, Dayton, Ohio

[73] Assignee: Southpaw Enterprises, Inc., Dayton, Ohio

[21] Appl. No.: 661,441

[22] Filed: Jun. 11, 1996

[51] Int. Cl.[6] ..... A47C 1/00

[52] U.S. Cl. ..... 297/314; 297/217.7

[58] Field of Search ..... 297/314, 217.7, 297/344.1, 423.42

[56] References Cited

U.S. PATENT DOCUMENTS 2,132,291 10/1938 Fitos ..... 297/314 X
2,489,981 11/1949 Rose ..... 297/314 X
2,707,986 5/1955 Johnson ..... 297/314 X
3,220,772 11/1965 Lucky ..... 297/423.42

FOREIGN PATENT DOCUMENTS 515835 9/1995 Canada ..... 297/314

*Primary Examiner*—Peter M. Cuomo
*Assistant Examiner*—Rodney B. White
*Attorney, Agent, or Firm*—R. William Graham

[57] ABSTRACT

An apparatus for providing universal mobility to a seat or chair and imparting a floatationlike sensation thereto, the apparatus includes a base operably positioned beneath the seat and members interconnecting the base and seat for providing universal mobility and a floatation effect to the seat.

7 Claims, 3 Drawing Sheets

APPARATUS FOR PROVIDING MOBILITY AND FLOATATION-LIKE EFFECT TO A SEAT OR CHAIR

BACKGROUND OF THE INVENTION

1. Field of the Invention

This invention relates to an apparatus which provides a therapeutic effect to a seat or chair to enhance psychological, physiological and learning capabilities.

2. Related Art

There are innumerable designs which exist for seats and chairs having therapeutic value. Many of these seats or chairs are designed to orient the body in a particular manner, usually a fixed position, to relieve stress and provide comfort to the user. However, there remains a need to improve seats or chairs to aid people, in particular, students, in their attention and thus learning capability. The present invention intends to improve conventional seats and chairs in this regard.

BRIEF SUMMARY OF THE INVENTION

It is an object to provide an apparatus which can enhance an individual's physiological, psychological and learning capabilities.

It is an object to enhance an individual's attention and learning capability.

It is an object to provide an apparatus which enhances an individual's attention and learning capability by adding universal mobility and floatation-like effect to a seat or chair.

It is another object to convert a conventional four legged chair into a chair which enhances an individual's attention and learning capability by adding universal mobility and floatation-like effect thereto.

Accordingly, the present invention is directed to an apparatus for providing universal mobility to a seat or chair and imparting a floatation-like sensation thereto, wherein the apparatus includes a base operably positioned beneath the seat and means interconnecting the base and seat for providing universal mobility and a floatation-like effect to the seat. The seat has at least one leg, and commonly four, extending therefrom and the universal mobility and floatation-like means includes means connected to the leg or legs for supportively retaining the legs in an elastic manner. As used herein, universal mobility means limited mobility in generally all directions as is encountered in rocking, swaying or bouncing.

Other objects and advantages will be readily apparent to those skilled in the art upon viewing the drawings and reading the detailed description hereafter.

DETAILED DESCRIPTION OF THE INVENTION

Figure 2:
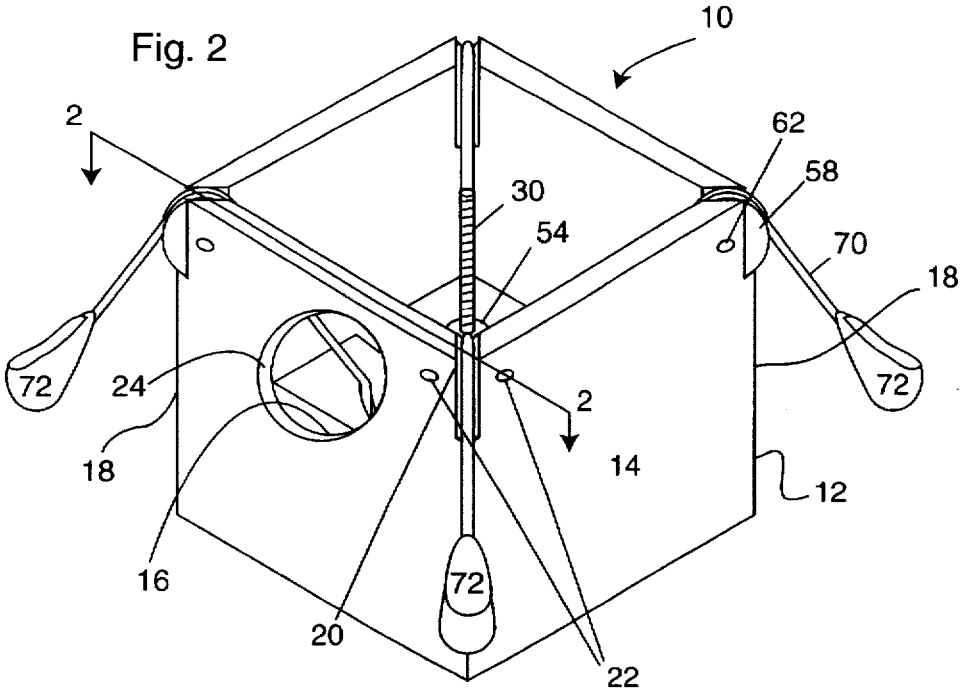
FIG. 2 is a perspective view of the present invention
Figure 3:
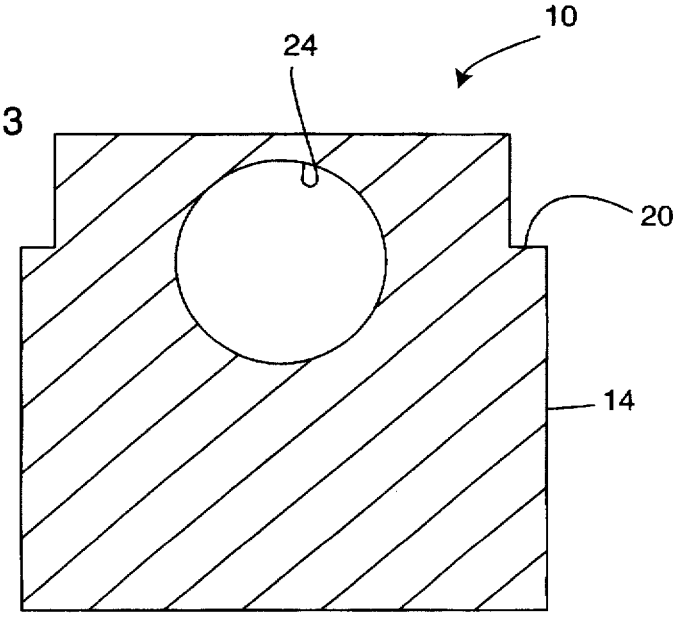
FIG. 3 is an end cross-sectional view of the present invention taken along line 2—2 of FIG. 2.
Figure 4:
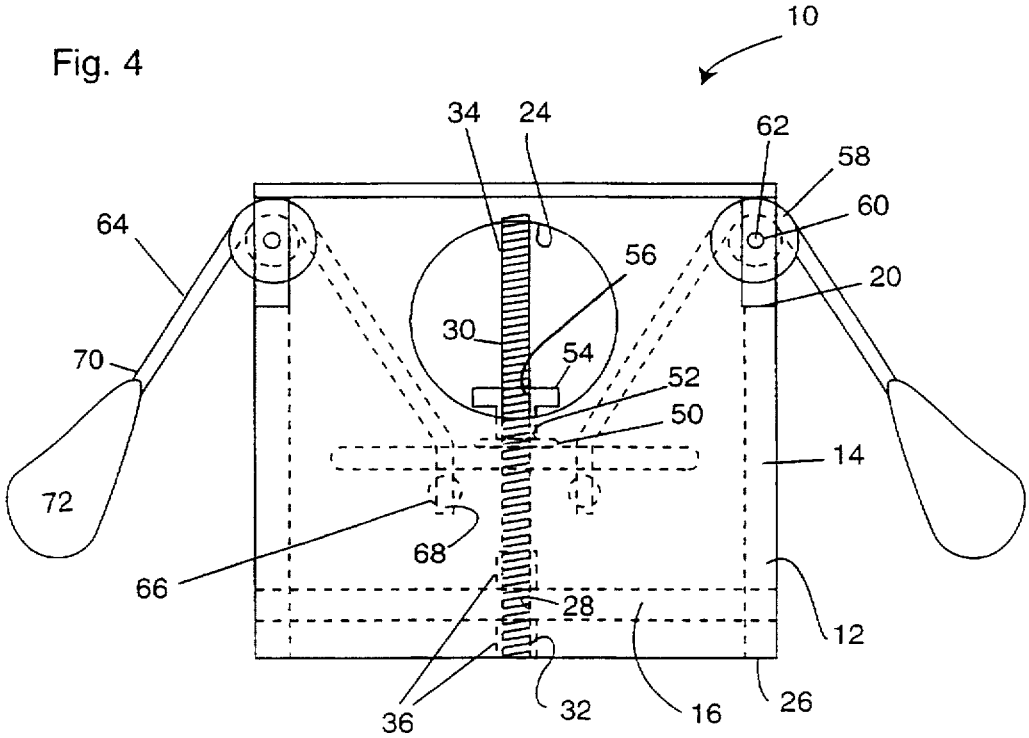
FIG. 4 is an end view of the present invention.

Referring to the drawings, the apparatus of present invention is generally designated by the numeral 10. As seen in FIGS. 2 and 4, the apparatus 10 includes a base 12 which is generally rectangular, but may have any suitable geometry to carry out the invention, and has sides 14 and a bottom 16. The sides 14 are connected at their corner edges 18 which are preferably mitered at about 45° to form a 90° corner of therebetween. Within an upper portion of corner edges 18 of the sides 14, there is a recessed surface 20. Additionally, there are bored surfaces 22 extending from sides 14 through the recessed surface 20 in a manner such that the bored surfaces 22 are coaxial with one another. The bored surfaces 22 are formed at 45° with respect to an outer surface of the side panels 14. One of the sides is preferably formed with an enlarged open surface 24 to permit an individual's hand to pass therethrough.

The bottom 16 is inset from bottom edges 26 of the sides 14 and connected to inner surfaces of the sides 14. An open surface 28 is generally centrally defined in the bottom 16.

A threaded bar 30 is of a diameter slightly less than the open surface 28 and of a length such that an end 32 of the bar 30 substantially extends through the open surface 28 of the bottom 16 and another end 34 of the bar 30 extends into an upper area within the base 12. Complimentary threaded lock nuts 36 are provided such that one lock nut 36 threads to the bar 30 below the bottom 16 and the other lock nut 36 threads to the bar 30 above the bottom 16 to lock the position of the bar 30 in place.

Figure 5:
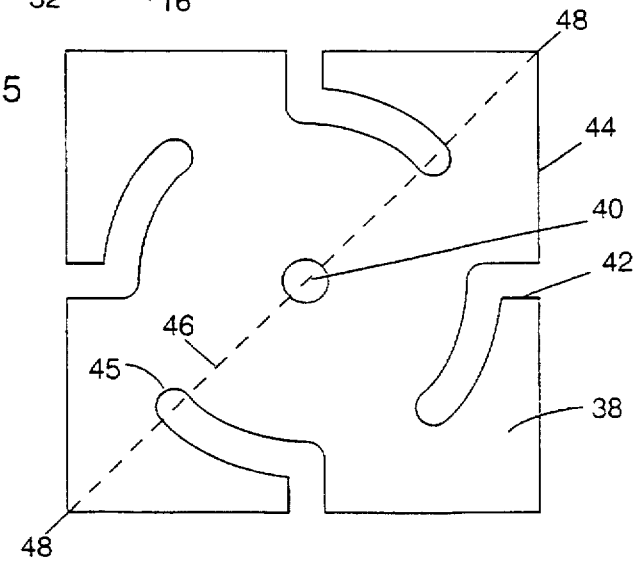
FIG. 5 is a top plan view of a retention plate of the present invention.

As seen in FIG. 5, a retention plate 38 is provided having an open surface 40 generally centrally defined therein, wherein the open surface 40 is of a slightly larger diameter than the diameter of the bar 30 to receive the same therethrough. There are four arcuate L-shaped slotted surfaces 42 formed in the plate 38, each of which begins about midway along an edge 44 and travels centrally inward a predetermined distance and then turns left to travel about 45° and terminate in an end 45 about a center line 46 drawn between corners 48. The plate 38 is disposed about the bar 30 via placing the bar 30 through open surface 40. The plate 38 is of a size such that when positioned on the bar 30, sufficient space exists between the edges 44 and inner surfaces of sides 14 to permit access and insertion of the elastic member 64 as described hereinafter.

Referring to FIG. 4, a washer 50 having an open surface 52 is disposed about the bar 30 adjacent the plate 38. A fluted knob 54 has an inner threaded open surface 56 of a size slightly greater than the bar diameter 30 and is complimentary threaded thereto.

Pulleys 58 are of a size to be operably disposed within the recessed surfaces 20 and have a central open bearing surface 60 generally equal to the bored surfaces 22. Four bearing pins 62 are provided. Each bearing pin 62 has a diameter slightly less than the diameter of bearing surface 60 and bored surfaces 22 and is operably disposed therethrough to permit the rotation of the pulley 58.

An elastic member 64 of a predetermined length is made of latex tubing, for example, and has a plastic ball 66 inserted in one end 68 to enlarge the same, the purpose of which is apparent from viewing the drawings and the description hereinafter. The elastic member's other end is 70 connected to a retaining pocket member 72 made of any suitable material for holding a variety of different shaped chair legs, such as plastic or cloth. The elastic member 64 can be of any suitable material such as natural or synthetic rubber, urethane, silicone or latex. Optionally, it is contemplated that those skilled in the art could devise gas struts or levered springs instead of the mechanism shown.

Figure 1:
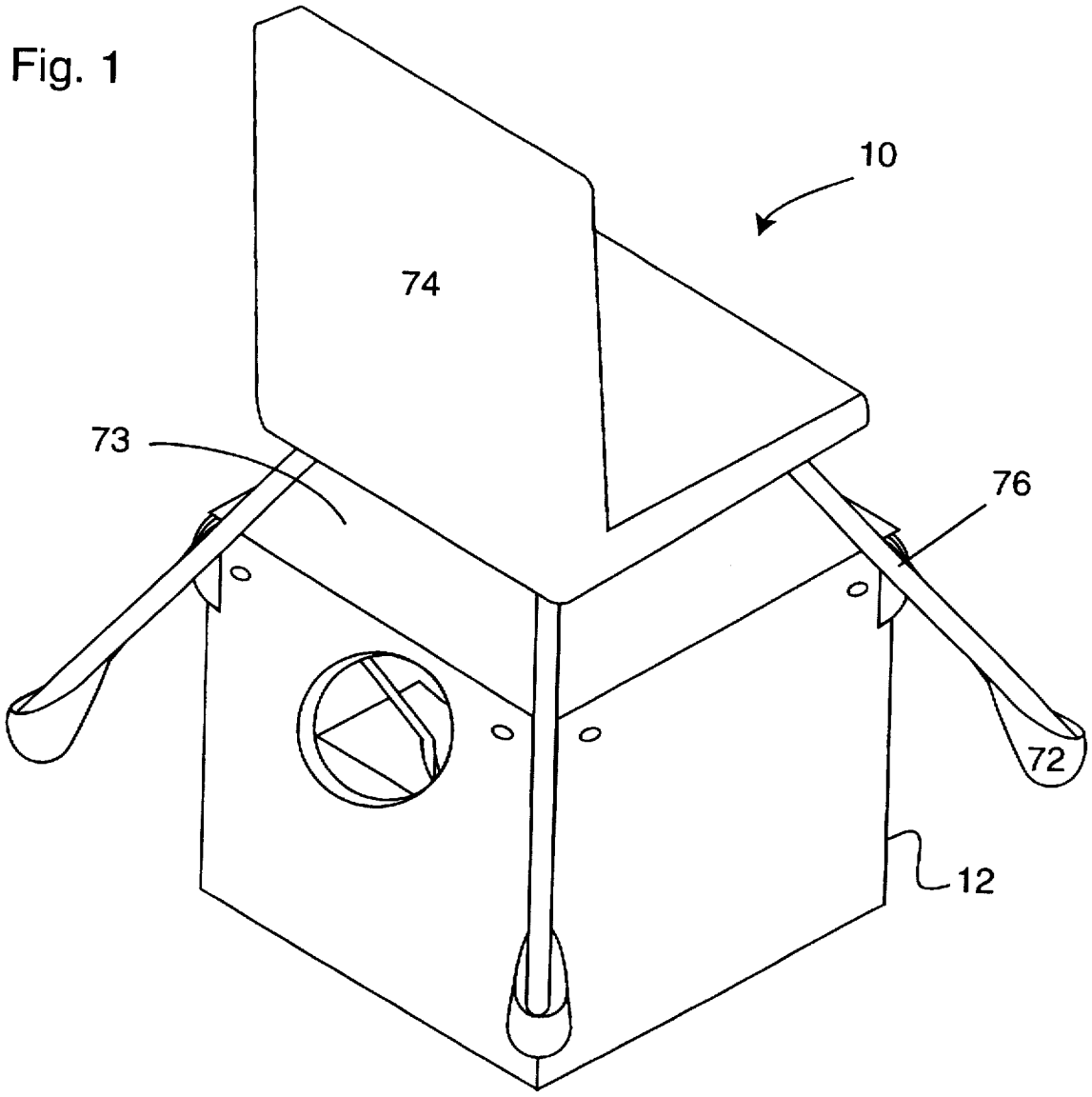
FIG. 1 perspective view of the present invention in its intended use.

A top cover 73, as seen in FIG. 1, is removably connected to the sides 14 to gain access inside the base 12 as desired.

The apparatus 10 can be of any suitable size and is preferably designed to be relatively compact and easily disposed beneath a chair 74 and out of the way of other individuals.

In operation, the end 68 of each elastic member 64 is pulled below the plate 38 and the portion of the elastic member 64 adjacent the end 68 is passed through the L-shaped slotted surface 42 and into the end 45. An intermediate portion of the elastic member 64 is disposed on the pulley 58 with the end 70 and pocket member 72 outside the base 12.

Each chair leg 76 of chair 74 is disposed in one of the retaining pocket members 72. The weight of the chair 74 draws the elastic member 64 taught which in turn causes the plate 38 and washer 50 to forcibly abut the knob 54. Depending upon the person's weight and desired mobility, the knob 54 can be upwardly or downwardly adjusted as desired to cause the plate 38 to move accordingly and thus achieve a desired mobility and floatation-like effect. When the top cover 73 is on the base 12, access to the knob 54 is via open surface 24.

By so providing, the present invention enhances the psychological, physiological, attention and learning capabilities of the individual, e.g., a student in a classroom, by allowing the individual to use a common chair to be converted to one having universal mobility to rock, sway and/bounce thereby providing the beneficial effects noted above. The above described embodiment is set forth by way of example and is not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. An apparatus for providing universal mobility to a seat and imparting a floatation-like sensation thereto, including:

a base operably disposed beneath the seat, wherein the seat has at least one leg extending therefrom;

means connected to the leg for supportively retaining the leg member in an elastic manner and for providing universal mobility and a floatation-like effect to the seat; and means for adjusting the degree of mobility of the retaining means.

2. An apparatus for providing universal mobility to a seat having at least one leg extending therefrom and imparting a floatation-like sensation thereto, including:

a base operably disposed beneath the seat:

means readily removably interconnecting said base and the seat for providing universal mobility and a floatation-like effect to the seat having means connected to the leg for supportively retaining the leg in an elastic manner wherein said retaining means includes an elastic member; and means connected to said elastic member for adjusting the position of said elastic member to effect the degree of mobility of the seat.

3. An apparatus for providing universal mobility to a conventional four legged chair and imparting a floatation-like sensation thereto, including:

a base operably disposed beneath the chair;

means readily removably interconnecting said base and the legs of the chair for providing universal mobility and a floatation-like effect to the chair, wherein said universal mobility and floatation-like means includes means connected to each leg for readily removably and supportively retaining the leg in an elastic manner.

4. The apparatus of claim 3 which further includes means for adjusting degree of mobility of said retaining means.

5. The apparatus of claim 3 wherein said readily removably and supportively retaining means includes four leg retaining members, wherein each one of said leg retaining members is connected to one of the legs and further includes four elastic members, wherein each one of said elastic members operably interconnects one of said retaining members to said base.

6. The apparatus of claim 5 which further includes means connected to said elastic members for adjusting said elastic member to a desired position to effect the degree of mobility of the seat.

7. The apparatus of claim 6 wherein the adjusting means includes a threaded bar connected to said base, a retention plate slidably disposed on said bar and connected to each said elastic member, and a threaded knob complimentary threaded to said bar and positioned adjacent said plate such that as said knob travels along said bar during threading said plate correspondingly travels along said bar adjacent said knob.

* * * * *